US007395949B2

(12) United States Patent
Ehret et al.

(10) Patent No.: US 7,395,949 B2
(45) Date of Patent: Jul. 8, 2008

(54) VOLUMETRIC DISPLACEMENT DISPENSER

(76) Inventors: Vincent Ehret, 411 S. Abert St., Mount Prospect, IL (US) 60056; Edward Eaton, P.O. Box 144, Eota, IL (US) 60519; Thomas Marchese, 1183 Regency Dr., Schamburg, IL (US) 60193

( * ) Notice: Subject to any disclaimer, the term of this patent is extended or adjusted under 35 U.S.C. 154(b) by 0 days.

(21) Appl. No.: 11/668,606

(22) Filed: Jan. 30, 2007

(65) Prior Publication Data

US 2007/0119875 A1 May 31, 2007

Related U.S. Application Data

(63) Continuation-in-part of application No. 11/332,277, filed on Jan. 13, 2006, now abandoned.

(51) Int. Cl.
*B67D 5/42* (2006.01)

(52) U.S. Cl. ..... 222/386.5; 222/387; 222/400.7; 222/478; 222/1; 215/231; 215/269; 215/307

(58) Field of Classification Search ..... 222/386.5, 222/400.7, 92, 387, 389, 1, 105, 95, 478, 222/479, 481; 215/231, 269, 307; 220/720
See application file for complete search history.

(56) References Cited

U.S. PATENT DOCUMENTS 2,673,013 A * 3/1954 Hester ..... 222/386.5
3,343,701 A * 9/1967 Mahoney ..... 215/231
3,361,303 A * 1/1968 Jacuzzi ..... 222/183
3,365,202 A 1/1968 Carleton
3,883,043 A 5/1975 Lane
4,011,971 A 3/1977 Haydon
4,763,818 A * 8/1988 Stefano et al. ..... 222/209
4,809,884 A * 3/1989 Stackhouse ..... 222/153.04
4,856,680 A 8/1989 Sitton
4,984,711 A 1/1991 Ellis
5,248,064 A 9/1993 Claycomb, Jr.
5,667,110 A 9/1997 McCann et al.
5,957,333 A 9/1999 Losenno et al.

* cited by examiner

*Primary Examiner*—J. Casimer Jacyna
(74) *Attorney, Agent, or Firm*—Howard M. Cohn

(57) ABSTRACT

A volumetric displacement dispenser and method of using the dispenser is disclosed for dispensing liquid contents from an interior of a bottle with a bottle neck while preventing air from filling a void created within the interior of the bottle caused by the liquid contents being poured out of the bottle by gravity. The dispenser includes a stopper having first and second boreholes extending there through, the stopper being adapted to form an air-tight seal when it is seated into the bottle neck. An air pressure tube routed through the first of the boreholes has a first end open to atmospheric air and a second end open to the interior of the bottle. An expandable volumetric displacement balloon is attached to the second end of the air pressure tube and a one-way liquid valve is disposed in the outlet of the liquid flow channel in the stopper.

7 Claims, 5 Drawing Sheets

VOLUMETRIC DISPLACEMENT DISPENSER

CROSS REFERENCE TO RELATED APPLICATIONS

This application is a continuation in part of U.S. application Ser. No. 11/332,277 entitled VOLUMETRIC DISPLACEMENT DISPENSER, and filed on Jan. 13, 2006, now abandoned which in turn claims the benefit of U.S. Provisional Patent Application Ser. No. 60/647,610, filed on Jan. 27, 2005.

FIELD OF THE INVENTION

The present invention specifically relates to a volumetric displacement dispenser to provide the individual user the capability of dispensing a given quantity of dispensable liquids or other beverages, such as wines or other perishable commodities, from a container and allowing the storage of the beverage over an extended period of time through the exclusion of air from the container; thus reducing degradation of the container contents whereby the desirable characteristics of the beverage are preserved in their original state. In one embodiment, the volumetric displacement dispenser comprises an air pump, check valves and an expandable polymer operative balloon of sufficient gauge and material whereby the balloon expands easily to fill a void occasioned by removal of wine from the wine container. The air pump in cooperation with the check valves operates to expand the operative balloon to dispense wine from the container by pressure of the expanded operative balloon. In another, more simplified embodiment, the volumetric displacement dispenser includes an inlet port connected to an expandable polymer balloon whereby the balloon expands easily to fill a void occasioned by removal of wine from the wine container. An outlet port in the volumetric displacement dispenser provides for removal of the wine from the container.

DESCRIPTION OF THE RELATED ART

An effective means for preserving wines and other beverages, once they have been initially decanted, has long been a problematic issue that has confronted the consumer of these commodities. Due to the broad spectrum of liquid commodities negatively impacted by prolonged exposure to air, the discussion of the related art centers about the preservation of wine.

Wine has long been recognized as a valued commodity that has transcended ancient times to present. Due to the chemical composition of wine, it is especially susceptible to degradation via oxidation processes that pose the risk of spoiling the flavor and bouquet in the short term and converting it to a less desirable product, i.e., vinegar, in the long term. Through the ages, there have been various attempts to develop an acceptable solution to this dilemma, wherein the preservation of foodstuffs was essential to trade and commerce, and daily aspects of life in ancient civilization. This point was further exacerbated given the fact that few control means existed to mitigate the degradation of wine from the extremes of environment. The most popular means of preserving wines was by limiting exposure to air (corking) and the addition of stones or oil and storing the wine in a cool area where exposure to sunlight was limited. In each of these methods, the container contained excess air and did not preserve the quality of the wine. Moreover, diffusion of air through the cork plays a role in the aging of the wine. A balance is required between amount of air required in the aging process and excess air beyond that required in aging. Advances, such as using wax to prevent entrance of air through the voids of the cork, improved the sealing properties of corking. However, without removal of air in the void space above the wine's surface, the wine was still subject to degradation. Stones or oil were introduced into the container to displace the air by displacement of the void volume. But each volume displacement method introduced new contaminants, (dirt, oil, bacteria, etc.) to the wine, which impaired the quality of the stored wine. Also, volume replacement by stones, glass or other solid media increased weight of the container, creating transportation problems. This method moreover served to negatively impact taste and body of the wine as bacteria and contaminants, which reacted with the wine, were introduced to the wine by the volume replacement objects. The use of oil as a volume replacement means served only slightly better as increased difficulty in decanting the wine had to be addressed. The need to completely extract the contents of the container required specialized extraction means as siphoning or use of unique containers to prevent the oil from being decanted with the wine. Another problem was that trace amounts of the oil were incorporated into the wine causing an oily taste and sometimes affecting the bouquet. The use of oils having relatively high paraffin contents and waxes solved some of the issues of separation. But, issues with decanting and contaminants still persisted.

A search for practical means of solving these issues has spawned a number of approaches. Some solutions relied on void volume reduction or sealing technology and means for introducing an inert gas to displace the air in the void space and removal of air by creating a vacuum.

Systems that use an inert gas are represented by Ellis, U.S. Pat. No. 4,984,711 ('711) wherein the wine dispenser utilizes a piercing means blanketed by an inert gas to avoid introduction of oxygen; thus, preserving the wine in its original state. This approach is both expensive and cumbersome to use, as the individual user expends additional effort in installing the dispenser on an uncorked bottle of wine. The installation is performed under pressure of the inert gas to prevent entrance of air. This can be a potential risk for the individual user, as the cork may be suddenly expelled and the contents discharged. It is noted that the Ellis '711 invention is limited to corked bottles and teaches no preservation technique for previously uncorked wines.

Sitton, U.S. Pat. No. 4,856,680 ('680), discloses preservation of a dispensed wine product by introducing the wine bottle and the remaining contents into a scaled container, wherein an inert gas such as nitrogen at a pressure exceeding 20 psig is introduced to purge the oxygen from the container. The container is then refrigerated and the contents of the bottle are withdrawn under pressure. This affords the user the possibility of preserving the wine for up to four to six weeks and preventing further aging of the wine. The Sitton '680 patent teaches use of a sealed container for the wine container and inert gas. This system though effective does not readily lend itself to those occasions when a consumer entertains a small party and it would be desirable to decant the wine by hand from the container.

Another popular methodology that has been employed has been the use of the beverage in a bag. U.S. Pat. No. 3,365,202 teaches application of pressure to a flexible bag containing a liquid to dispense the liquid contained therein. Although this patent teaches decanting the liquid within the bag through a decrease in volume obtained through external force, this patent does not address the problem of air entrance into the previously decanted liquid container.

Several patents attempt to solve this problem by inserting an inert gas through the cork stopper and extracting the wine without removing the cork. U.S. Pat. No. 3,883,043 to Lane and U.S. Pat. No. 4,011,971 to Haydon disclose devices utilizing a hollow needle inserted through the bottle cork to withdraw the wine and to introduce an inert gas into the void space above the wine. However, the insertion of the hollow needle through the bottle cork can introduce air into the void space above the wine level and cause deterioration of the contained wine. Also, as Sutton '680 teaches, as most beverages and wines are stored in glass containers, the amount of pressure that can be applied to the container is limited.

Another attempt at preservation extensively employed by many consumers of wines has been the use of devices to draw the air out of a bottle subsequent to re-corking the bottle. However, the success of this system has been variable, as a number of physical parameters limit the effectiveness of this technique. These parameters are the ability to induce a sufficient vacuum to reduce the volume of air in the bottle, the ability to maintain a vacuum once achieved and the ability to indicate when the required vacuum has been obtained. As these devices rely on the penetration of the stopper, even given the compressive qualities of corks, rubber and other materials used as stoppers, it is difficult to maintain a required vacuum for any length of time. Further, since wines are slowly aged in their bottles through the diffusion of oxygen through corks, changing the parameters of the cork would tend to shift the diffusion dynamics toward oxidation of the wine. Another shortcoming of this approach is the failure to foresee the trend of winemakers away from cork and toward plastic lined metal screw caps, which will not work with these systems.

Given the shortcomings and disadvantages of existing approaches to preserving wines and other dispensable liquids impacted by the effects of oxygen, an affordable and convenient means is desirable to preserve the quality of once-opened containers of wine from the harmful effects of ambient atmosphere.

ASPECTS AND SUMMARY OF THE INVENTION

It is accordingly an aspect of this invention to provide an invented device and method that provides a means to preserve the quality and bouquet of a wine and prevent further aging of the wine by minimizing introduction of air into the wine container and causing an occupation of the void space within the container by an expandable displacement dispenser that serves to protect the contained wine from contact with the ambient atmosphere.

It is accordingly another aspect of this invention to provide a wine preservation and dispensing system for bottled wine to allow wine to be dispensed from the bottle by the glass while protecting the wine in the bottle from the harmful effects of being exposed to the ambient air.

It is therefore a further aspect of this invention to provide a bottle cap assembly comprising (a) an air pump or a source of compressed gas, (b) air and liquid check valves, (c) an operative expandable polymer balloon, (d) a liquid discharge tube, (e) a casing for the operative expandable polymer balloon, and (f) a separate cap for the bottle cap assembly, associated tubing, retaining clips and connectors which, in combination, operate as a volumetric displacement dispenser of wine from a bottled container of wine.

It is yet another aspect of this invention to provide a dispenser for wine bottles, which provides a volumetric displacement balloon of sufficient flexibility to occupy the void space within a wine container caused by removal of decanted wine, which balloon is caused to expand by suction from the removal of wine from the container and the atmosphere air pressure which enters into the balloon through the bottle cap assembly.

It is another object of this invention to provide an alternative source of compressed gas versus an air pump to cause the operative balloon to expand to occupy the void space in a wine container between the liquid and the container.

It is still another aspect of this invention to provide a method for insertion of the volumetric displacement dispenser into a wine bottle while protecting contents of the bottle from ambient air.

Accordingly, the present invention relates to several devices and methods for dispensing a beverage from a bottle container and preventing harmful effects of air upon the contents of the bottle. The devices are specifically termed a volumetric displacement dispenser. The volumetric displacement dispensers are utilized in lieu of a cork or other closure for a container so as to preserve dispensable liquids, wines or other perishable commodities, wherein the liquids have a prolonged shelf life as the deleterious effects of oxygen are mitigated. The use of one embodiment of the volumetric displacement dispenser, comprising check valves, loop seals and an expanding operative balloon, allows the individual user to readily dispense the liquid contained within the container without need to recork, purging the container of air, or evacuating the atmospheric contents of the container as a function of dispensing the liquid. Recognizing the need for convenience and ease of use, the volumetric displacement dispenser operative balloon operates at atmospheric pressure. The check valves and loop seal permit liquids or gases to flow only in one direction and thus prevent loss of pressure on liquids or gases. Only a minimum of applied pump pressure is applied to insure that the volumetric displacement dispenser operative balloon obtains initial contact with the surface of the fluid therein. This serves to purge a small volume of the dispensable liquid to insure a liquid full system. Thereafter, whenever the liquid dispensing valve is opened and the fluid is decanted, atmospheric air is drawn into the volumetric displacement operative balloon by extraction of wine from the container. The volumetric displacement operative balloon is sufficiently flexible to occupy the void caused by the removal of the decanted wine. As air fills the volumetric displacement operative balloon, the space within the container is filled and entrance of oxygen restricted. Transparent tubing in the cap assembly can provide visual confirmation to the user that the system is liquid full.

According to the present invention, a volumetric displacement dispenser for dispensing liquid contents from a bottle with a bottle neck while preventing air from filling a void in the bottle caused by the removal of the liquid contents of the bottle, comprises: a stopper having first and second tube boreholes extending there through, the stopper being adapted to be seated into the bottle neck; an air/gas pressure tube routed through the first of the tube boreholes; an air pump/air vent assembly disposed in the air/gas pressure tube having an air/gas check valve inserted therein, the air pump/air vent assembly being open to atmospheric air; a liquid discharge tube routed through the second of the tube boreholes, the liquid discharge tube having a liquid control device incorporated therein; and an expandable volumetric displacement balloon attached to a first end of the air/gas pressure tube, the volumetric displacement balloon being expanded by air pressure from the from the air pump/air vent assembly. The liquid control device can be a check valve disposed in the liquid discharge tube.

Further according to the present invention, there is an elongated casing secured at one end to encase the expandable balloon. The elongated casing is attached to the first end of the air/gas pressure tube.

Still further according to the present invention, the volumetric displacement dispenser includes a source of compressed gas connected to a second end of the air/gas pressure tube, the source of compressed gas comprises a manually operated air pump or an external source of compressed gas.

Yet further according to the present invention, there is a dispensing liquid outlet attached an end of the liquid discharge tube and a liquid dispensing valve disposed between the end of the liquid discharge tube and the liquid discharge tube.

According to the present invention, a method for dispensing liquid contents of a bottle with a bottle neck while preventing air from filling a void in the bottle caused by the removal of the liquid contents of the bottle, comprises the following steps: a stopper having first and second tube boreholes extending there through is seated into the bottle neck of a bottle containing a liquid; compressed air is applied through an air pump/air vent assembly open to atmospheric air and having an air/gas check valve, and then into an air/gas pressure tube routed through the first of the tube boreholes into an expandable volumetric displacement balloon connected to the air/gas pressure tube whereby the balloon is inflated so that a small amount of the liquid is dispensed from the bottle through a dispensing liquid outlet attached to an end of a liquid discharge tube routed through the second of the tube boreholes; the liquid from the bottle is dispensed through the dispensing liquid outlet whereby atmospheric air from the air pump/air vent assembly flows into the volumetric displacement balloon and causes the balloon to expand and fill the void in the bottle corresponding to the volume of liquid dispensed from the bottle Further according to the present invention, the method comprises the step of encasing the expandable balloon in an elongated casing attached to the second end of the air/gas pressure tube to enable the expandable balloon to be inserted through the bottle neck into the bottle.

Still further according to the present invention, the method includes the step of using a manually operated air pump to cause compressed air to flow through the air/gas check valve. Alternatively, an external source of compressed gas can cause compressed air to flow through the air/gas check valve.

According to the present invention, a volumetric displacement dispenser for dispensing liquid contents from an interior of a bottle with a bottle neck while preventing air from filling a void created within the interior of the bottle caused by the liquid contents being poured out of the bottle by gravity comprises: a stopper having first and second boreholes extending there through, the stopper being adapted to form an air-tight seal when it is seated into the bottle neck; an air pressure tube routed through the first of the boreholes, the pressure tube having a first end open to atmospheric air, and a second end open to the interior of the bottle; an expandable volumetric displacement balloon attached to the second end of the air pressure tube; and a one-way liquid valve disposed in the outlet of the liquid flow channel in the stopper.

Further according to the present invention, the air pressure tube is unobstructed to allow atmospheric air from outside the bottle to flow directly into the expandable volumetric displacement balloon and the second end of the air pressure tube extends into the interior of the bottle. Moreover, an elongated casing is disposed within the expandable balloon. The elongated casing is attached to the second end of the air pressure tube so that the expandable balloon can be inserted into the bottle when the stopper is seated into the bottle neck. The elongated casing has a slot extending along its length to and into which the expandable balloon is tucked into the casing after being folded so that the balloon can expand out into the interior of the bottle when atmospheric air is drawn through the air pressure tube into the balloon.

Still further according to the present invention, a pouring spout is fitted within the second borehole with an opening there through forming a flow channel for pouring out the liquid from within the bottle. The pouring spout is connected to the outlet of the liquid one-way valve.

According to the present invention, a method for dispensing liquid contents of a bottle with a bottle neck while preventing air from filling a void in the bottle caused by the removal of the liquid contents of the bottle comprises: seating a stopper having first and second tube boreholes extending there through into the bottle neck to form an airtight seal with the bottle neck; routing an unobstructed air pressure tube through the first of the tube boreholes, the pressure tube having a first end open to atmospheric air, and a second end in communication with the open end of a volumetric displacement balloon disposed within the bottle; dispensing the liquid from the bottle through the second borehole while atmospheric air is simultaneously drawn through the unobstructed air pressure tube directly into the volumetric displacement balloon whereby the displacement balloon expands and fills the void in the bottle corresponding to the volume of liquid dispensed from the bottle.

Further according to the present invention, the method comprises the step of providing a liquid one-way valve in the second borehole to allow liquid within the bottle to pour flow out of the bottle via the liquid one-way valve while substantially preventing atmospheric air from entering the bottle through the second borehole.

Still further according to the present invention, the method further comprises the step of encasing an elongated casing attached to the second end of the air pressure tube with the expandable balloon to enable the expandable balloon to be inserted through the bottle neck into the bottle. The elongated casing is provided with a slot extending along its length into which the expandable balloon is tucked into the casing after being folded to allow the expandable balloon to expand out into the interior of the bottle when atmospheric air is drawn through the air pressure tube into the balloon.

Other objects, features and advantages of the invention will become apparent in light of the following description thereof.

BRIEF DESCRIPTIONS OF THE DRAWINGS

The structure, operation, and advantages of the present invention will become further apparent upon consideration of the following description taken in conjunction with the accompanying figures (FIGS.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, often both reference numerals and legends (labels, text descriptions) may be used to identify elements. If legends are provided, they are intended merely as an aid to the reader, and should not in any way be interpreted as limiting.

Often, similar elements may be referred to by similar numbers in various figures (FIGS.) of the drawing, in which case typically the last two significant digits may be the same, the most significant digit being the number of the drawing figure (FIG).

DETAILED DESCRIPTION OF THE INVENTION

Referring to FIGS. 1-5, the Figures illustrate several embodiments of the volumetric displacement dispenser device comprising a flexible inflatable operative balloon and means permitting liquids and gases to flow only in one direction.

Figure 1:
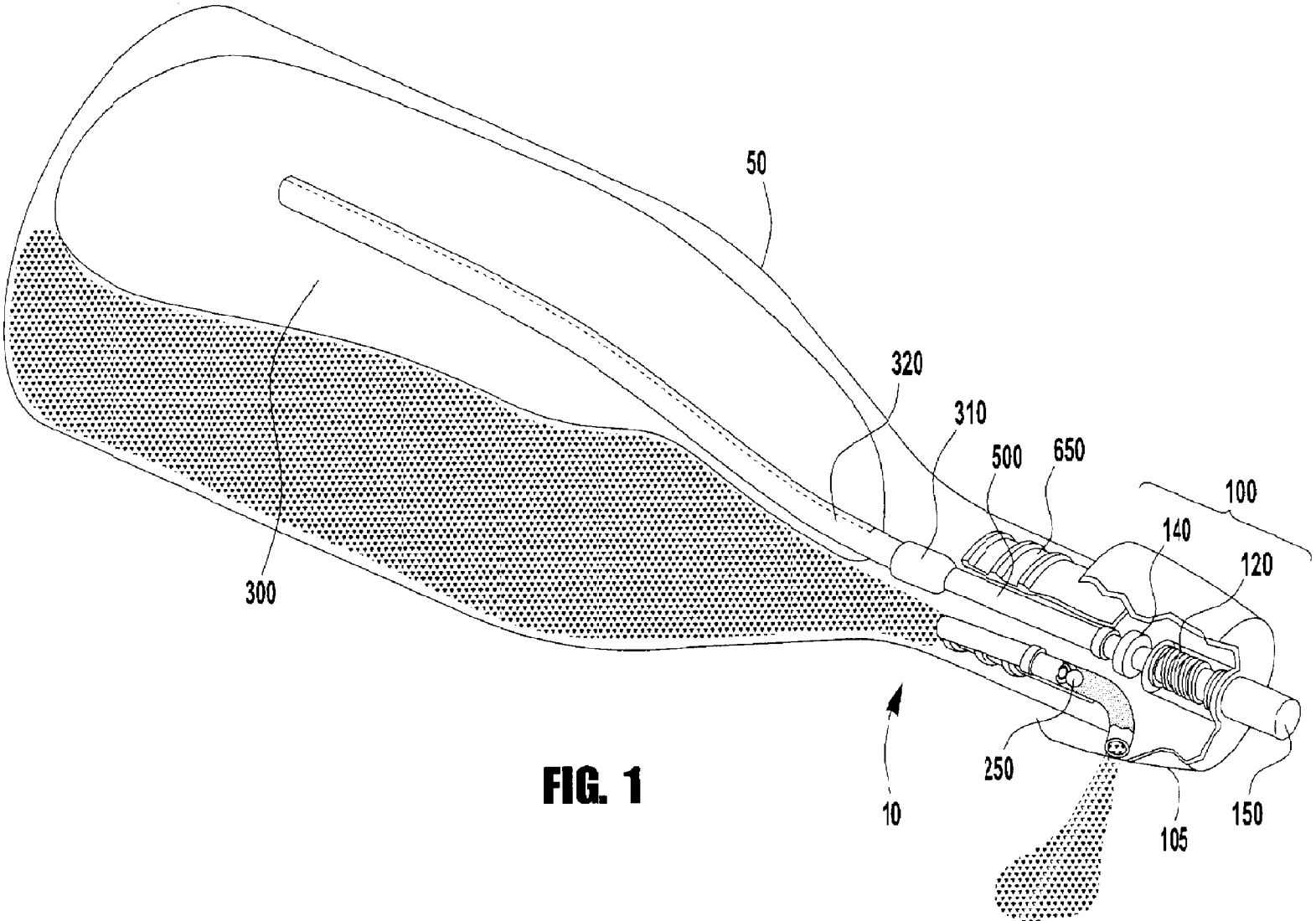
FIG. 1 illustrates an embodiment of the invention wherein an air pump is affixed to an air inlet in the cap assembly to pump air into the volume displacement dispenser operative balloon and an air/gas check valve is operable in the air/gas pressure tube to the operative balloon and a check valve is operable in the liquid discharge tube.
Figure 2A:
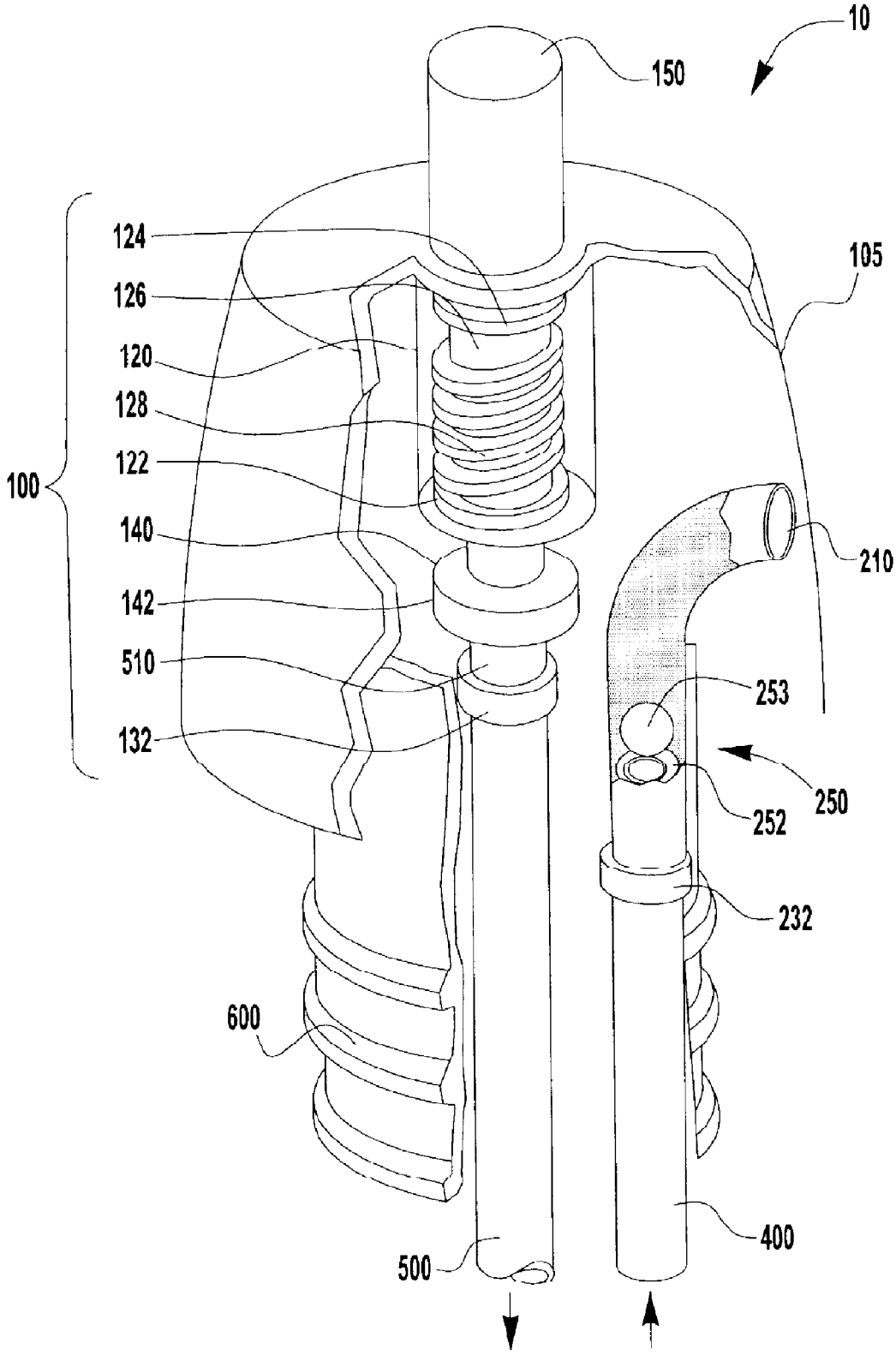
FIG. 2A illustrates the details of the embodiment of FIG. 1.

Referring to FIGS. 1 and 2A, volumetric displacement dispenser 10 is illustrated as inserted in a bottle 50 by ported stopper 600 wherein components of said dispenser 10 comprise a cap assembly 100. Cap assembly 100 comprises cap-air pump 105 with one aperture on the top surface for air pump piston shaft 150 and further comprises air pump/air vent assembly 120 connected to air/gas pressure tube 500 with air/gas check valve 140 inserted therein. Cap assembly 100 further comprises a liquid discharge tube 400 wherein liquid check valve 250 is inserted therein. Volumetric displacement device casing 320 is retained by retaining clip 310 on air/gas pressure tube 500. Volumetric displacement operative balloon 300 is also connected to air/gas pressure tube 500 by retaining clip 310. Air pump piston shaft 150 comprising an air pump means is positioned on piston 126 of air pump/air vent assembly 120 to pump air into volumetric displacement operative balloon 300 as required.

Figure 3:
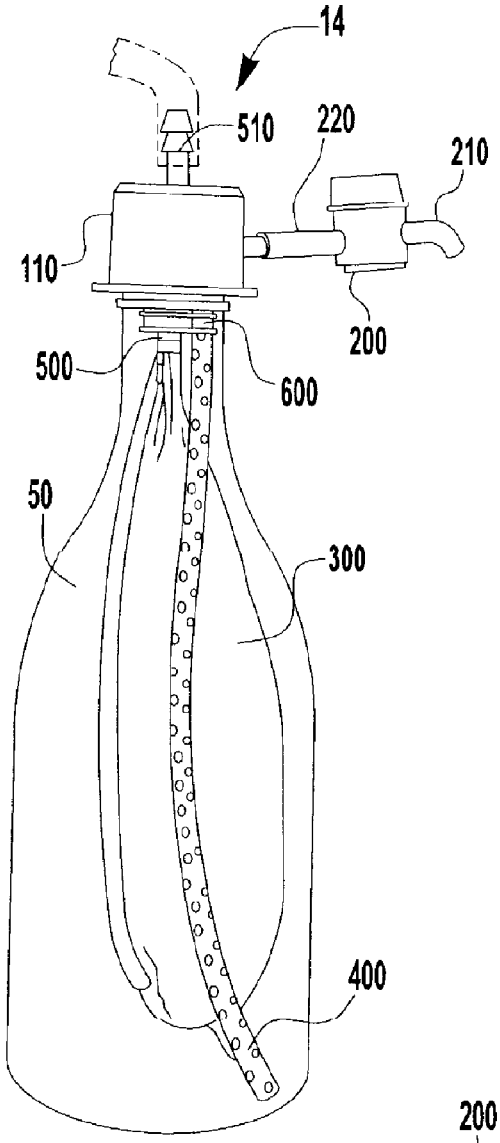
FIG. 3 illustrates an alternative embodiment of the instant invention wherein an external source of a compressed gas is applied to pressure the operative balloon to expand.
Figure 5:
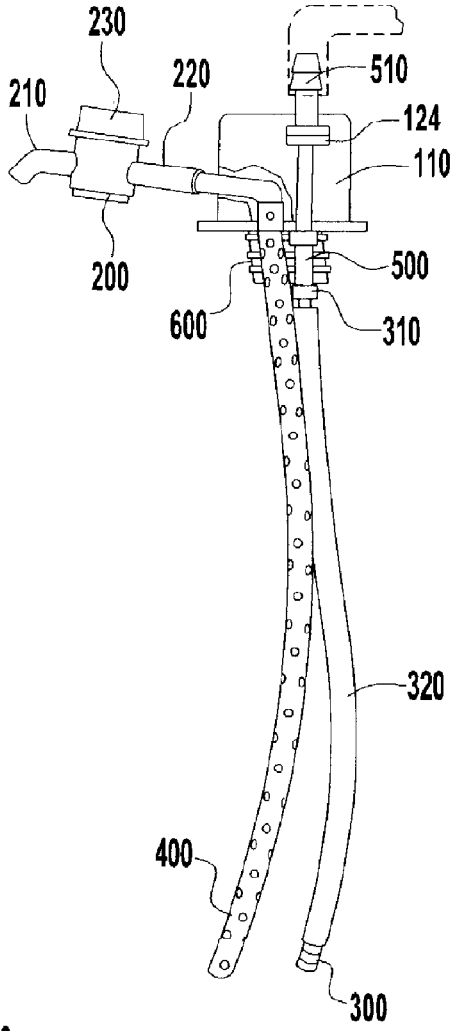
FIG. 5 illustrates the further details of the embodiment of FIG. 3.
Figure 4:
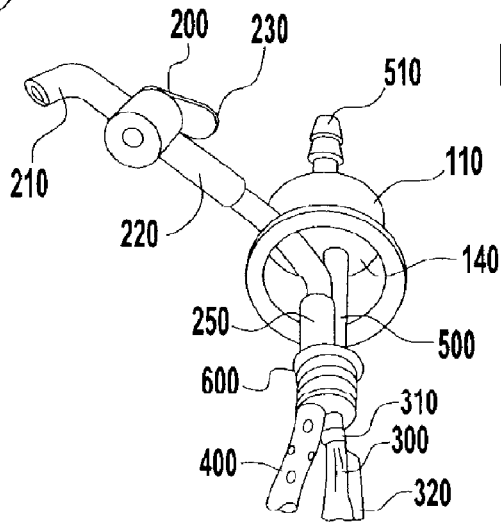
FIG. 4 illustrates the details of the embodiment of the cap of FIG. 3.

Referring to FIG. 2A, the details of the embodiment of cap assembly 100 of the volumetric displacement dispenser 10 of FIG. 1 are illustrated. Air pump/air vent body 122 contains air pump piston shaft 150 positioned on air pump/air vent assembly 120, which comprises piston 126 and piston spring 128. Air/gas check valve 140 containing air check valve flapper 142 (not shown) is interposed between air pump/air vent assembly 120 and air/gas pressure tube 500 to prevent backflow and to control air injected into volumetric displacement device operative balloon by operation of air pump/air vent assembly 120. Retainer 124 seats air pump piston shaft 150 on air pump/air vent assembly 120. Inlet air connector 132 secures pressure tube inlet 510 to air/gas pressure tube 500. Liquid discharge tube 400 is preferably of a length shorter than the air/gas pressure tube 500. It is, however, within the terms of the invention to provide the liquid discharge tube 400 with perforations as shown in FIGS. 3-5. The liquid discharge tube 400 and air/gas pressure tube 500 are inserted through fitted bores in ported stopper 600. Discharge tube connector 232 secures liquid discharge tube 400 to liquid check valve 250 comprising liquid check valve seat 252, a ball check valve 253 and liquid spigot 210. Note that the liquid spigot 210 at the end of discharge tube 400, as shown in FIGS. 1 and 2A, is disposed at 90° or less with the elongated discharge tube.

Figure 2B:
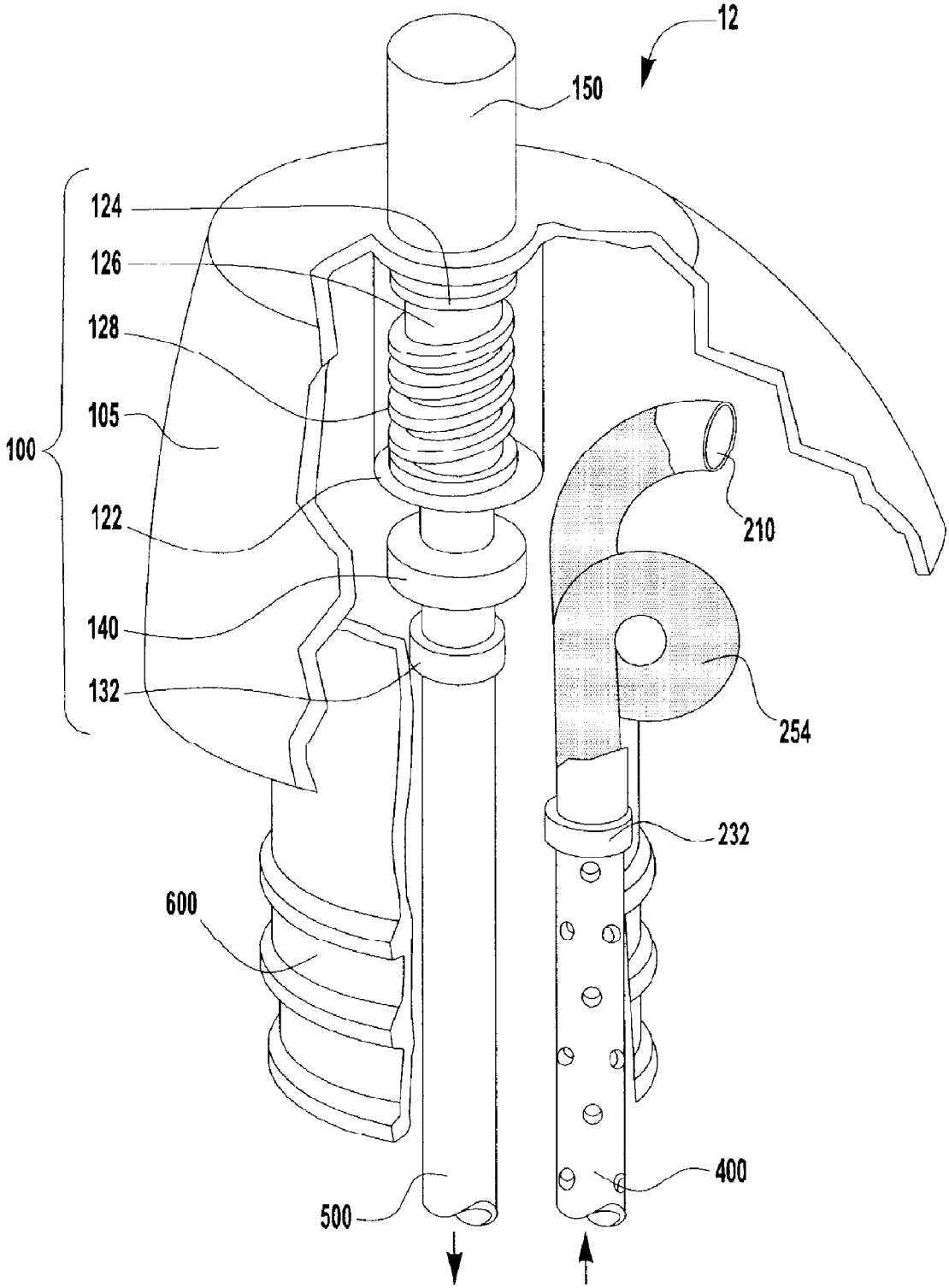
FIG. 2B illustrates an alternative embodiment of the invention of FIG. 1 wherein the liquid discharge tube uses a loop seal in place of a check valve.

FIG. 2B illustrates an alternative embodiment of the volumetric displacement dispenser 10 of FIGS. 1 and 2A. In FIG. 2B, volumetric displacement dispenser 12 incorporates a loop seal 254 at the outlet end of liquid discharge tube 400 instead of liquid check valve 250 and liquid check valve seat 252 as in FIG. 2A. All other details of the volumetric displacement dispenser 12 are the same as the volumetric displacement dispenser 10 as illustrated in FIGS. 1 and 2A.

FIGS. 3-5 illustrate another alternative embodiment of a volumetric displacement dispenser. In FIG. 3, a volumetric displacement dispenser 14 is inserted in bottle 50 by ported stopper 600. An external inert gas supply (not shown) under pressure supplies pressurized gas to volumetric displacement operative balloon 300 through pressure tube inlet 510 and retainer 124 to volumetric displacement operative balloon 300. Volumetric displacement operative balloon 300 is attached to air/gas pressure tube 500 by retaining clip 310 (See FIG. 5), which also retains volumetric displacement device casing 320 which encompasses operative balloon 300 to facilitate insertion of operative balloon 300 into bottle 50. Cap—external gas 110 of the alternative embodiment has two apertures, one on the top surface for pressure tube inlet 510 and one on the side surface for dispensing liquid outlet 220. Liquid outlet 220 dispenses liquid through liquid spigot 210 attached thereto by operating dispensing valve operator 230 of liquid dispensing valve 200. Preferably, the liquid outlet 220 is constructed of a clear material such that a user can check the bottle is full of liquid at all time.

The expandable operative balloon 300 is essential for application of any of the volumetric displacement dispenser devices of the present invention. As an operative element of the volumetric displacement dispenser device, the expandable volumetric displacement operative balloon 300 is essential for the physical operation of the volumetric displacement dispenser device and performs the necessary operation for the volumetric displacement dispenser device to fill the void occasioned by removal of wine from the wine container 50. The expansion of the volumetric displacement operative balloon 300 under pressure also operates to pressurize the dispensing of wine from the container 50. As shown in FIG. 1, balloon fills the void caused by the removal of the wine from the bottle. Essentially, there is a pressure void created in the bottle as the wine is dispensed which causes air to automatically be drawn into the balloon through the air pump/air vent assembly 120.

Air/gas check valve 140, liquid check valve 250 and/or loop seal 254 in liquid discharge tube 400 are essential for operation of the volumetric displacement operative balloon 300. As operative elements, the check valve 250 and the loop seal 254 are essential for the physical operation of the volumetric displacement operative balloon 300 by controlling and preventing backflow of gases and liquids to control flow of the respective gases and liquids.

Further referring to FIGS. 1-5, the figures illustrate preferred embodiments of a volumetric displacement dispenser in accordance with the present invention.

Referring to FIG. 1, the bottle 50 is shown in a position where the contents, typically wine, are being poured out from the discharge tube 400. Note that the operative balloon 300 fills the empty portion of the bottle 50 as the contents are poured out. In effect, the balloon 300 floats on the liquid contents keeps the flow path to the discharge tube 400 free. The balloon 300 is initially is filled partially with pressurized gas using the air pump 105. Once the balloon 300 is partially expanded and the wine flows from the bottle, the balloon continues to expand as the negative pressure in the bottle causes atmospheric air to enter the balloon from the air pump/air vent assembly 120.

Referring to FIGS. 1-5, three embodiments of a volumetric displacement dispenser are generally shown at 10, 12 and 14. In FIGS. 1 and 2B, volumetric displacement dispenser 10 comprises cap 105 of cap assembly 100 and a check valve 250 for a first embodiment. In FIG. 2B, volumetric displacement dispenser 12 comprises cap 105 of cap assembly 100 and a loop seal valve 254 for a second embodiment. In FIGS. 3-5, an alternative cap-external gas 110 is provide for third embodiment.

The cap assembly 100 (FIG. 1) of the first embodiment further comprises air pump/air vent assembly 120 connected to air pump/air vent body 122 (FIG. 2A) of pressure tube inlet 510, which is subsequently routed through a fitted bore in ported stopper 600 by air/gas pressure tube 500 and connected to volumetric displacement device operative balloon 300 (FIG. 1) by upper retaining clip 310 (FIG. 1). Retaining clip 310 also retains volumetric displacement device casing 320 in position encompassing operative balloon 300.

The second embodiment shown in FIG. 2B is essentially identical with the first embodiment of FIGS. 1 and 2A except the check valve 250 of the first embodiment is replaced with the loop seal valve 254.

The cap-external gas 110 of an alternative embodiment shown in FIGS. 3-5, comprises pressure tube inlet 510, a liquid dispensing valve 200, a dispensing valve operator 230 (FIGS. 4-5), liquid spigot 210 (FIGS. 3-5) and dispensing liquid outlet 220 (FIGS. 3-5) connected to liquid discharge tube 400, which is subsequently routed through a fitted bore in ported stopper 600 (FIGS. 3-5) wherein liquid discharge tube 400 (FIG. 3) extends into the bottle 50 in contact with the vessel's contents.

In operation, any of the volumetric displacement dispensers 10, 12 or 11 are placed into a bottle 50. The ported stopper 600 (FIGS. 1-5) is securely seated to provide an air tight and air-pressure tight seal within the neck of the bottle 50, wherein cap assembly 100 and cap with cap 105 and cap-external gas 10 cover the outer surface of the neck of the bottle 50.

The volumetric displacement dispensers 10, 12 or 14 may be inserted into any vessel or container, irrespective of the configuration wherein evacuation of air or maintenance of an inert environment is desirable for the preservation of the fluids contained therein. In preferred embodiments, cap assembly 100 with cap 105 and cap-external gas 110 may have an outer flexible sealing ring (not shown) about the base of cap assembly 100 with cap 105 and cap-external gas 110 to engage the outer surface of the neck of the bottle 50 thereby forming a seal to prevent contaminants from entering the bottle 50 or the internals of cap assembly 100 with cap 105 and cap-external gas 110. The outer sealing ring may be comprised of any polymeric, elastomer material including but not limited to rubber, plastic, copolymer compounds or cork. In another embodiment, the outer sealing ring may be an integral element of the cap assembly.

The volumetric displacement dispensers 10, 12 and 14 construction material can be selected from a group consisting of polymers, polymer alloys, non-ferrous metals, ferrous metals, carbon fiber, carbon powder, silicone polymers, elastomers, glass, ceramics and combinations thereof. The tubing can be transparent to allow visual confirmation of the operation of the device. When indicated, use of the volumetric displacement dispenser 10, 12 or 14 is for food or sanitary usage, compliance with U.S. Department of Agriculture (USDA) or U.S. Food and Drug Administration (FDA) regulations regarding the selected materials of construction is necessary. The volumetric displacement dispensers may be manufactured by any technique recognized in the Mechanical Arts but not limited to molding, casting, forging, sintering, spinning, polishing, plating and any combinations thereof which are capable of yielding a finished product satisfying regulatory guidelines governing the use of such products, i.e. FDA, USDA, etc.

In a first embodiment of FIG. 2A, the user applies a pressure source of compressed air by operation of air pump piston shaft 150 and air pump/air vent assembly 120 to air/gas check valve 140. Compressed air flows through air check valve flapper 142 to pressure tube inlet 510, to air/gas pressure tube 500 and into volumetric displacement operative balloon 300. Liquid check valve 250 prevents backflow of gases. The initial application of air pressure to operative balloon 300 will cause flow of wine from liquid spigot 210. That is, the manual pump 150 is intended to initially purge any remaining air in the bottle after the volumetric displacement dispensers 10 has been inserted into the bottle. The purging of the air is affected by the initial pressurizing of the volumetric displacement operative balloon 300 which initially causes any air trapped in the bottle to flow from the liquid spigot. Once the wine begins to flow from the spigot, any air trapped in the bottle is essentially removed.

In an alternate embodiment of FIG. 1 (see FIG. 2B), liquid spigot 210 is connected to vertical loop seal 254 wherein the loop seal comprises at least one 360° loop of tubing for 360° vertical circular flow. Loop seal 254 acts to control outflow of liquid spigot 210 and acts to prevent backflow of gases into the container/vessel.

In another embodiment (FIGS. 3-5), the user applies a pressure source of an external compressed inert gas that is greater than the atmospheric pressure to the pressure tube inlet 510 using a coupling connector (not shown), which protrudes vertically from top surface of cap-external gas 110. Pressure tube inlet 510 is retained in position as cap-external gas 110 by retainer 124. The compressed gas flows through air/gas check valve 140 to air/gas pressure tube 500 into volumetric displacement operative balloon 300. Concurrently, the user opens liquid dispensing valve 200 on the dispensing liquid outlet 220 to liquid spigot 210.

In the embodiment (FIGS. 3-5), a liquid may be employed in lieu of a gaseous pressure source. This allows the air or other gases in the bottle 50 to be purged through perforated tube 400 while the volumetric displacement operative balloon 300 inflates by the liquid pressure and occupies the void space in the bottle 50 thus forcing the liquid up perforated tube 400 through liquid check valve 250 and out liquid spigot 210, until the user closes the liquid dispensing valve 200 (FIGS. 3-5). When the user decants the contained liquid, dispensing valve 200 is opened causing the internal and external pressure to equilibrate.

In the first embodiment, upon drawing fluid from the bottle 50, suction force is applied to the surface of the volumetric displacement operative balloon 300 in contact with the liquid resulting in balloon inflation by drawing in atmospheric air through the air pump/air vent assembly 120. The suction force on the volumetric displacement operative balloon 300 is transmitted to the air/gas check valve 140 by pressure tube inlet 510 to air pump/air vent assembly 120. Air/gas check valve 140 is drawn open by the negative suction force wherein air is admitted in a volume directly corresponding to the volume of liquid decanted. This process is repeated by the user until the volume of liquid in the bottle 50 is decanted. In another embodiment (not shown), air/gas check valve 140 may comprise a mechanism for temperature compensation, wherein the spring tension of the valve closure may respond to colder temperatures by reducing the spring tension, and conversely by increasing the spring tension upon exposure to increases in temperature.

In the embodiment shown in FIGS. 3-5, application of additional measured amounts of compressed gas results in added decantation of wine from the container by inflation of the operative balloon.

Further, referring to FIGS. 1-5, additional details of the volumetric displacement dispenser are generally shown. Referring to cap-air pump 105 of cap assembly 100 (FIGS. 1, 2A-2B) and cap-external gas 110 (FIGS. 3-5) each have a given shape, height, circumference, a top, a base, a contiguous circumferential side, an inside surface and an outside surface. Air pump/air vent assembly 120 is connected to cap-air pump 105 of cap assembly 100 underside by retainer 124 (FIGS. 2A-2B). Air pump/air vent body 122 (FIG. 2A) has an inlet (not shown). Retainer 124 (FIGS. 2A-2B, 5), is in communication with air/gas check valve 140 (FIGS. 2A, 2B, 4) wherein air/gas check valve 140 is disposed to operation by the user and is connected to pressure tube inlet 510 (FIG. 2A); and air/gas pressure tube 500 (FIGS. 1-5), subsequently terminating in volumetric displacement operative balloon 300. The volumetric displacement operative balloon 300 with capacity to yield to a minimum suction force or vacuum has resistance to tearing and rupture in event of over-pressurization, moderate impulse forces or cyclic forces. The pressure tube inlet 510 is connected to air/gas pressure tube 500 by inlet air connector 132 (FIG. 1). The volumetric displacement operative balloon 300 is connected to air/gas pressure tube 500 by retaining clip 310. Both air/gas pressure tube 500 and liquid discharge tube 400 are routed through ported stopper 600 with each tube borehole in substantial agreement with the outside diameter of each tube. Thereby, a pressure and watertight seal is facilitated to provide isolation of the contents of the bottle 50 or other similar container from the environment.

In alternative embodiments of cap assembly 100 and cap-external gas 110 (FIGS. 2A-2B, 3-5), air/gas check valve 140 can comprise a connection means such as but not limited to a nipple, union, hose barb, solder joint, coupling and any other fitting known in the Mechanical Arts to permit a number of volumetric displacement dispensers' inlets to be connected to a manifold. Compressed air or an inert gas can be supplied as required through the manifold to inflate the volumetric displacement operative balloon 300 (FIG. 3). This alternative embodiment requires that the manifold (not shown) has at least one demand valve having an adjustable set pressure range for predetermined pressure.

Referring to FIGS. 1 and 3, the volumetric displacement operative balloon is shown as 300. The volumetric displacement operative balloon 300 comprises a flexible membrane of a given shape, length and diameter, having a first end, a second end and having at least one opening in the first end, which is responsive to a suction force or vacuum at minimal increments developed by a suction force or vacuum from removal of fluid, wherein a corresponding enlargement of the membrane occurs. The volumetric displacement operative balloon 300 may comprise a membrane having a configuration in substantial agreement with the container in which the volumetric displacement dispenser 10 is utilized such that the entire volume of the container is occupied by the volumetric displacement operative balloon 300 upon inflation.

The volumetric displacement operative balloon 300 membrane typically is of varying gauge corresponding to the length and symmetry of the container/vessel. Upon inflation, the volumetric displacement operative balloon 300 expands. As stated earlier, the volumetric displacement operative balloon 300 comprises materials of construction required by the U.S. Food and Drug Administration for food grade polymers and elastomers, and must not evidence wear or deterioration from contact with the fluid or the container/vessel.

Specifically, referring to FIG. 2A, illustrating a first embodiment, cap-air pump 105 of cap assembly 100 is shown in accordance with the present invention. Cap-air pump 105 encloses air pump/air vent assembly 120, air pump/air vent body 122, retainer 124, liquid spigot 210 and ported stopper 600.

Air pump/air vent assembly 120 (FIG. 2A) comprises air pump/air vent body 122 with an air inlet (not shown) in the topside of cap-air pump 105. Retainer 124 secures the air pump/air vent assembly 120 to cap-air pump 105 while simultaneously serving as a guide for piston 126 in the bore of air pump/air vent body 122. Piston 126 is maintained in spaced agreement with the internal walls of air pump/air vent body 122. The downward axial travel of piston 126 is opposed by piston spring 128, having a spring constant and force in direct contact with the piston 126.

In operation, a method of use of the instant invention is detailed for the user to employ the following sequence to replace an existing container stopper with the volumetric displacement dispenser 10 (FIGS. 1-5) in the following procedure:

(a) Remove the original container seal.

(b) Determine if volumetric displacement operative balloon 300, casing 320 and liquid discharge tube 400 can be inserted into the container opening and if cap assembly 100 will seal the container opening.

(c) Insert volumetric displacement operative balloon 300 and liquid discharge tube 400 into the container, taking care not to disconnect pressure tube inlet 510 and air/gas pressure tube 500 from inlet air connector 132 and discharge tube connector 232.

(d) Insert cap assembly 100 into the container opening until the cap assembly base is firmly seated against the top of the container opening.

(e) Insure that cap assembly 100 fits tightly into the container.

(f) Inflate the volumetric displacement operative balloon 300 until a small volume of the dispensable liquid is decanted. Transparent tubing in cap assembly 100 can provide visual confirmation that the system is liquid full.

(g) Close liquid dispensing valve 200 if applicable.

(h) In the event that the volumetric displacement operative balloon 300 loses contact with the dispensable liquid, the sequence is repeated.

Open liquid dispensing valve 200 and withdraw liquid from the container. The user should observe that the volumetric displacement operative balloon 300 expands, maintaining contact with the dispensable liquid.

A table of reference characters used for parts of the volumetric displacement dispenser follows.

TABLE OF REFERENCE CHARACTERS FOR PARTS OF THE VOLUMETRIC DISPLACEMENT DISPENSER

| Reference Character | Part Term |
|---|---|
| 10 | VOLUMETRIC DISPLACEMENT DISPENSER |
| 50 | BOTTLE |
| 100 | CAP ASSEMBLY |
| 105 | CAP-AIR PUMP |
| 110 | CAP-EXTERNAL GAS |
| 120 | AIR PUMP/AIR VENT ASSEMBLY |
| 122 | AIR PUMP/AIR VENT BODY |
| 124 | RETAINER |
| 126 | PISTON |
| 128 | PISTON SPRING |
| 132 | INLET AIR CONNECTOR |
| 140 | AIR/GAS CHECK VALVE |
| 142 | AIR/GAS CHECK VALVE FLAPPER |
| 150 | AIR PUMP PISTON SHAFT |
| 200 | LIQUID DISPENSING VALVE |
| 210 | LIQUID SPIGOT |
| 220 | DISPENSING LIQUID OUTLET |
| 230 | DISPENSING VALVE OPERATOR |
| 232 | DISCHARGE TUBE CONNECTOR |
| 250 | LIQUID CHECK VALVE |
| 252 | LIQUID CHECK VALVE SEAT |
| 254 | LOOP SEAL |
| 300 | VOLUMETRIC DISPLACEMENT OPERATIVE BALLOON |
| 310 | RETAINING CLIP |
| 320 | VOLUMETRIC DISPLACEMENT DEVICE CASING |
| 400 | LIQUID DISCHARGE TUBE |
| 500 | AIR/GAS PRESSURE TUBE |
| 510 | PRESSURE TUBE INLET |
| 600 | PORTED STOPPER |

In summary, the instant invention comprises a volumetric displacement dispenser for bottles for dispensing measured quantities with exclusion of air from contents of the dispensing bottle, the liquid dispenser embodied as a bottle cap assembly wherein said bottle cap assembly, as a volumetric displacement dispenser, in combination, comprises: (a) a separate cap for said bottle cap assembly, (b) a means for a source of compressed gas, (c) an air/gas check valve, (d) a liquid control means, (e) an expandable operative polymer balloon, (f) a casing of polymer material to encase said expandable operative polymer balloon, (g) a ported stopper to seat said bottle cap assembly in neck of dispensing bottle, and (h) associated polymer tubes, retaining clips and tubing connectors.

The means for a source of compressed gas can comprise a manually operated air pump, which comprises a piston shaft, a piston, a piston spring, a retainer for the air pump/air vent body, an air pump/air vent body assembly and an air pump/air vent body.

The means for a source of compressed gas can comprise an external source of compressed gas for attachment to an external pressure tube inlet by coupling connector inserted through said separate cap for said bottle cap assembly and held in place by a retainer. The source of compressed gas can comprise a source of an inert gas comprising a cylinder of compressed gas.

The air/gas check valve comprises an air/gas check valve flapper positioned in the air/gas pressure tube.

The liquid control means comprises: (a) a liquid check valve seat, (b) a liquid check valve, (c) a perforated liquid discharge tube, (d) a liquid dispensing valve, (e) dispensing valve operator, (f) a dispensing liquid outlet, and (g) a liquid spigot.

The liquid control means comprises (a) a perforated liquid discharge tube and (b) a vertical loop seal in said liquid discharge tube wherein said vertical loop seal consists of at least one 360° loop of tubing for at least one 360° circular loop of vertical liquid flow.

The ported stopper has fitted bores, which route tubes through said stopper and said stopper is sized to securely seat within neck of the dispensing bottle.

A method of use of the instant invention to replace an existing container stopper with the volumetric displacement dispenser with exclusion of air from contents of the dispensing bottle comprises the following procedure:

(a) Remove the original container seal.

(b) Determine if the operative balloon encased in the balloon casing and liquid discharge tube is insertable into the container opening and if the dispenser portal stopper seals the container opening.

(c) Insert the operative balloon encased in the balloon casing and liquid discharge tube into the container opening, taking care not to disconnect the pressure tube inlet and air/gas pressure tube from the inlet air connector and discharge tube connector.

(d) Insert the cap assembly into the container opening until the cap assembly ported stopper is firmly sealed in the container opening.

(e) Insure cap assembly fits tightly in the container.

(f) Inflate the operative balloon until a small volume of liquid from the container is decanted and the operative balloon contacts the surface of the dispensable fluid.

(g) In the event the operative balloon loses contact with the contained fluid, the sequence is repeated.

ADDITIONAL EMBODIMENT

Figure 6:
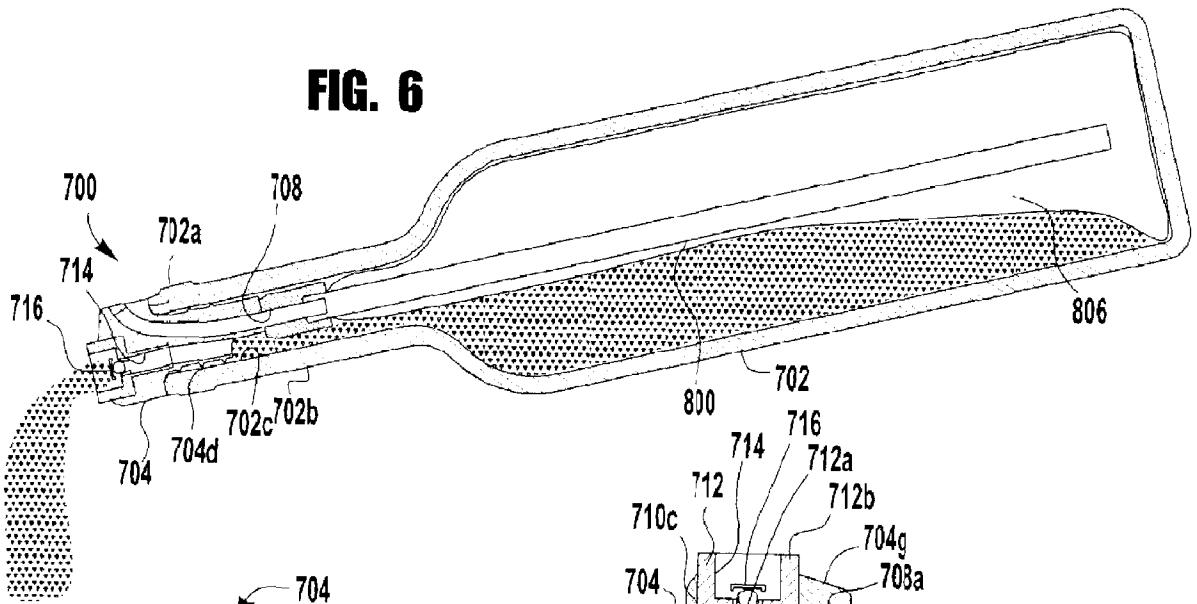
FIG. 6 is a cross sectional view of an alternative embodiment of a volumetric displacement dispenser according to the present invention wherein the air inlet is free of check valves and sources of compressed gas to provide unimpeded air flow from the atmosphere to cause an operative balloon to expand.
Figure 7:
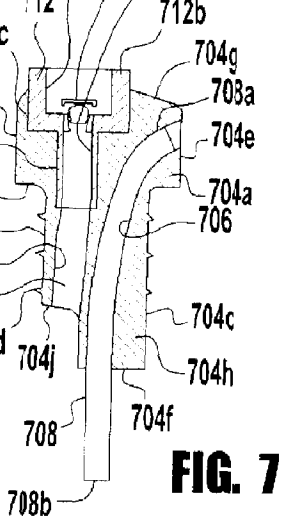
FIG. 7 is a cross sectional view illustrating the details of the volumetric displacement dispenser shown in FIG. 6.
Figure 9:
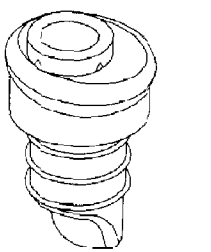
FIG. 9 is an isometric view of the volumetric displacement dispenser as shown in FIG. 7.

Referring to FIGS. 6 and 7, an alternative embodiment of a volumetric displacement dispenser 700 is illustrated. In FIG. 6, the volumetric displacement dispenser 700 is shown inserted in a bottle 702. The dispenser 700 includes the ported stopper 704 as best seen in FIGS. 7 and 9. The ported stopper 704 has a generally, cylindrical head portion 704*a* with a bottom surface 704*b* that is engageable over the mouth 702*a* of the bottle neck 702*b*. The ported stopper 704 also has a generally, cylindrically shaped stem portion 704*c* integrally connected and extending from the bottom surface 704*b* of head portion 704*a*. The cylindrically shaped stem portion 704*c* has a ridge 704*d* that spirals around and projects from the cylindrically shaped stem portion 704*c* to engage the internal surface 702*c* of the bottle neck 702*b*. The ridge 704*d* is an important aspect of the present invention in that it insures that the ported stopper 704 forms an airtight seal with the bottle neck 702*b*. While ridge 704*d* is shown, it is within the terms of the present invention to insure that an airtight seal is formed by any means such as a simple force fit of the stopper into the bottle neck 702*b*. The cylindrically shaped stem portion 704*c* also has a first portion 704*h* which extends to a bottom end 704*f* and a second portion 704*i* that is slightly more than half the length of the stem portion 704*c* and extends to a bottom end 704. The spacing between the bottom ends 704*f* and 704*j* allows for easier flow of the liquid contents from the bottle 702 when the expandable balloon 806 expands, as discussed in more detail below.

Figure 8:
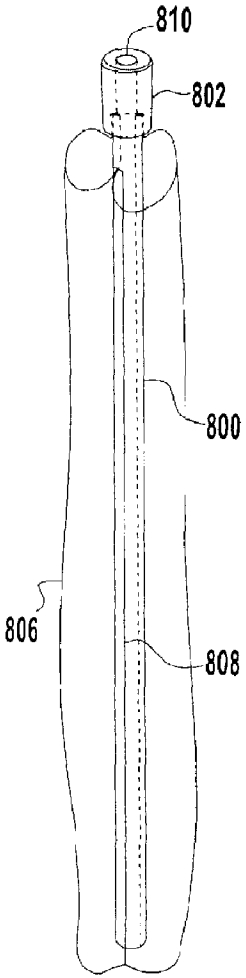
FIG. 8 is an isometric view of a casing for a volumetric displacement device adapted to be connected to the volumetric displacement dispenser as shown in FIG. 6.

As shown in FIG. 7, a first tube borehole 706 extends through the ported stopper 704 from the side surface 704*e* of the cylindrical head portion 704*a* to the bottom end 704*f* of the cylindrically shaped stem portion 704*c*. Within the first tube borehole 706, there is disposed an air pressure tube 708 routed there through so that a first open end 708*a* is slightly recessed from the side surface 704*e* and is open to atmospheric air when the stopper 704 is seated in the bottle neck 702*b*. A second open end 708*a* of air pressure tube 708 extends outward from bottom end 704*f* a distance whereby the elongated sleeve 802 at one end of the elongated casing 800, as shown in FIG. 8 and discussed in detail hereinafter, can be mounted onto the air pressure tube so that an end of the sleeve is disposed against the bottom end 704*f* of the cylindrically shaped stem portion 704*c*. The air pressure tube 708 provides an unobstructed path for atmospheric air to flow directly into the expandable balloon.

Referring again to FIG. 7, a second borehole 710 extends through the ported stopper 704 from the upper surface 704*g* of the cylindrical head portion 704*a* to the bottom end 704*j* of the cylindrically shaped stem portion 704*c*. The second borehole 710 has a first section 710*a* that is open at the bottom end 704*j* end and is within cylindrical head portion 704*a*. The section 710*a* connects to a second section 710*b* that has a slightly larger diameter than section 710*a*. A third section 710*c*, joined to second section 710*b*, opens to the upper surface 704*g* of the head portion 704*a* and is effectively a counter bore.

A pouring spout 712 is fitted within the second borehole 710. The pouring spout 712 has a lower section 712*a* that is fitted into second section 710*b* and an upper section 712*b* that is fitted into the third section 710*c* of the borehole 710 and projects outward from the upper surface 704*g* of the head portion 704*a*. The pouring spout 712 has an inner passageway 714 extending there through to provide a path there through to decant the liquid within the bottle to which the stopper 704 is disposed. Within the inner passageway 714 through the pouring spout 712 is a one-way valve 716 which normally closes the passageway through the pouring spout except when the liquid contents are being poured out. The one way valve 716 provides an important function of the invention. That is, it prevents atmospheric air from entering the bottle whenever the liquid contents are not being poured out through the pouring spout 712. Never the less, the specific type of one-way valve is not important to the present invention.

Referring to FIG. 8, there is shown an elongated casing 800 to house the expandable volumetric displacement balloon 806. The balloon 806 has the casing 800 disposed within the balloon so that the open end 806*a* of the balloon is wrapped around one end 800*a* of the elongated casing 800. An elongated sleeve 802, mounted to one end 800*a* of the casing 800, secures the open end of the balloon 806 to the end of the casing so that the bore 810 through the sleeve is open to the open end 806*a* of the balloon. Typically, the end of the open end of balloon 806 is folded over the open end of the casing 808 so that when the elongated sleeve is mounted on to the end of the casing 800, the balloon is fixed there between. The casing 800 has a slot 808 extending along its length so that the balloon can be folded and partially disposed within the casing 800.

The elongated sleeve 802, at one end of the elongated casing 800, as shown in FIG. 6, is mounted onto the air pressure tube 708 so that an end of the elongated sleeve is disposed against the bottom end 704F of the cylindrically shaped stem portion 704C. The use of the elongated casing 800 having a slot 808 extending along its length, to facilitate the folding of at least a part of the balloon into the slot within the casing, is necessary so that the balloon 806 can be easily put into the bottle 702 when the volumetric displacement dispenser 700 is inserted in a bottle 702. The slot 808 extending along the length of the elongated casing 800 allows the expandable balloon 806 to expand out into the interior of the bottle 702 when atmospheric air is drawn through the air pressure tube into the balloon, as described hereinafter.

The expandable operative balloon 806 (compare operative balloon 300) is essential for application of any of the volumetric displacement dispenser device 700 of the present invention. As an operative element of the volumetric displacement dispenser device 700, the expandable volumetric displacement operative balloon 806 is essential for the physical operation of the volumetric displacement dispenser device and performs the necessary operation for the volumetric displacement dispenser device to fill the void occasioned by removal of wine from the wine container 702.

In operation, volumetric displacement dispenser 700 is placed into a bottle 702. The ported stopper 702 is securely seated to provide an air tight and air-pressure tight seal within the neck of the bottle 50 and the cylindrical head portion 704A is engageable over the mouth 702A of the bottle neck 702B.

The volumetric displacement dispenser 700 may be inserted into any vessel or container, irrespective of the configuration wherein evacuation of air or maintenance of an inert environment is desirable for the preservation of the fluids contained therein. In the preferred embodiment, ported stopper 702 may have an outer sealing ridge 704D about the cylindrically shaped stem portion 704C to engage the inner surface of the neck of the bottle 702 thereby forming a seal to prevent contaminants from entering the bottle.

The volumetric displacement dispenser 700's construction material can be selected from a group consisting of polymers, polymer alloys, non-ferrous metals, ferrous metals, carbon fiber, carbon powder, silicone polymers, elastomers, glass, ceramics and combinations thereof. The tubing 708 can be transparent to allow visual confirmation of the operation of the device. When indicated, use of the volumetric displacement dispenser 700 is for food or sanitary usage and compliance with U.S. Department of Agriculture (USDA) or U.S. Food and Drug Administration (FDA) regulations regarding the selected materials of construction is necessary. The volumetric displacement dispensers may be manufactured by any technique recognized in the Mechanical Arts which are capable of yielding a finished product satisfying regulatory guidelines governing the use of such products, i.e. FDA, USDA, etc.

In the embodiment shown in FIGS. 6-9, upon pouring liquid (typically wine) from the bottle 702 (preferably a wine bottle), as shown in FIG. 6, a suction force is applied to the surface of the volumetric displacement operative balloon 806 in contact with the liquid resulting in balloon inflation by drawing in atmospheric air through the air pressure tube 708. To create the suction force, it is important to create an airtight closure of the ported stopper 704 so that the only air going into the bottle is going into the balloon 806 and the only liquid leaving the bottle is through pouring spout 712. The negative suction force created by the liquid being poured from the bottle 702, as shown in FIG. 6, causes a volume of air to be drawn into the balloon 806 directly corresponding to the volume of liquid decanted. The balloon 806 floats on the liquid within the bottle and allows the liquid to flow through a path to the pouring spout 712. When pouring the liquid, the opening of the air pressure tube 708 is preferably above the pouring spout 712 as shown in FIG. 6. Note that the balloon 806 does not require to be slightly inflated before the atmospheric air will expand the balloon. This process is repeated by the user until the volume of liquid in the bottle 702 is decanted.

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

What is claimed is:

1. A volumetric displacement dispenser for dispensing liquid contents from an interior of a bottle with a bottle neck while preventing air from filling a void created within the interior of the bottle caused by the liquid contents being poured out of the bottle by gravity, the displacement dispenser comprising:

a stopper having first and second boreholes extending there through, the stopper being adapted to form an air-tight seal when it is seated into the bottle neck;

an air pressure tube routed through the first of the boreholes, the pressure tube having a first end and a second end and with the first end open to atmospheric air, and the second end open to and extending into the interior of the bottle;

an expandable volumetric displacement balloon attached to the second end of the air pressure tube;

a pouring spout in the second of the boreholes, said pouring spout having a one-way liquid valve disposed therein for preventing atmospheric air from entering the interior of the bottle through the second of the boreholes; and further including an elongated casing disposed within the expandable balloon, the elongated casing being attached to the second end of the air pressure tube so that the expandable balloon can be inserted into the bottle when the stopper is seated into the bottle neck; and wherein the elongated casing has a slot extending along its length to and into which the expandable balloon is tucked into the casing after being folded so that the balloon can expand out into the interior of the bottle when atmospheric air is drawn through the air pressure tube into the balloon.

2. The volumetric displacement dispenser of claim 1 wherein the air pressure tube is unobstructed to allow atmospheric air from outside the bottle to flow directly into the expandable volumetric displacement balloon.

3. The volumetric displacement dispenser of claim 1 the pouring spout is fitted within the second borehole has an opening there through forming a flow channel for pouring out the liquid from within the bottle and having the one-way liquid valve disposed therein.

4. The volumetric displacement dispenser of claim 3 wherein the pouring spout is connected to the outlet of the liquid one-way valve.

5. A method for dispensing liquid contents of a bottle with a bottle neck while preventing air from filling a void in the bottle caused by the removal of the liquid contents of the bottle, comprising the steps of:

seating a stopper having first and second tube boreholes extending there through into the bottle neck to form an airtight seal with the bottle neck;

routing an unobstructed air pressure tube through the first of the tube boreholes, the pressure tube having a first end open to atmospheric air, and a second end in communication with the open end of a volumetric displacement balloon disposed within the bottle;

dispensing the liquid from the bottle through the second borehole while atmospheric air is simultaneously drawn through the unobstructed air pressure tube directly into the volumetric displacement balloon whereby the displacement balloon expands and fills the void in the bottle corresponding to the volume of liquid dispensed from the bottle; and encasing the expandable balloon within an elongated casing attached to the second end of the air pressure tube to enable the expandable balloon to be inserted through the bottle neck into the bottle.

6. The method of claim 5 further comprising the step of providing a liquid one-way valve in the second borehole to allow liquid within the bottle to pour flow out of the bottle via the liquid one-way valve while substantially preventing atmospheric air from entering the bottle through the second borehole.

7. The method of claim 5 further comprising the step of providing the elongated casing with a slot extending along its length into which the expandable balloon is tucked into the casing after being folded to allow the expandable balloon to expand out into the interior of the bottle when atmospheric air is drawn through the air pressure tube into the balloon.

* * * * *